United States Patent [19]

Trubiano

[11] Patent Number: 4,691,816

[45] Date of Patent: Sep. 8, 1987

[54] LOCKING DEVICE FOR INTERLOCKING NESTED SHOPPING CARTS

[75] Inventor: Antoine Trubiano, Pointe aux Trembles, Canada

[73] Assignee: Cari-All Inc., Montreal East, Canada

[21] Appl. No.: 777,526

[22] Filed: Sep. 19, 1985

[51] Int. Cl.[4] ..... G07F 7/00; G07F 17/10

[52] U.S. Cl. ..... 194/212; 194/257; 194/905

[58] Field of Search ..... 194/905, 257, 212, 205, 194/253

[56] References Cited

U.S. PATENT DOCUMENTS

| | | | |
|---|---|---|---|
| 2,753,970 | 7/1956 | Breeler | 194/905 X |
| 3,163,277 | 12/1964 | Naef | 194/257 |
| 4,401,202 | 8/1983 | Gitlin et al. | 194/257 |
| 4,474,280 | 10/1984 | Lenander | 194/905 X |
| 4,573,564 | 3/1986 | Rheeder et al. | 194/905 X |

FOREIGN PATENT DOCUMENTS

| | | | |
|---|---|---|---|
| 0070997 | 6/1983 | European Pat. Off. . | |
| G8121677 | 12/1981 | Fed. Rep. of Germany . | |
| WO84/04835 | 12/1984 | PCT Int'l Appl. | 194/905 |

*Primary Examiner*—F. J. Bartuska

*Attorney, Agent, or Firm*—Burns, Doane, Swecker & Mathis

[57] ABSTRACT

A locking device for interlocking at least two nested shopping carts. The device comprises a housing which is attachable at a predetermined location on a shopping cart, usually but not exclusively, the handlebar thereof. A coin-activated unlocking actuator is movably mounted in the housing for limited inward displacement thereof on a working axis. A locking mechanism is also displaceably mounted inside the housing and has a locking pin and lock pin displacing member. A key element is received in a key slot provided in the housing and is immovably engaged by the lock pin. An actuator retention member engages the actuator and is comprised of one or more retention elements, one of which has a pin ejector associated therewith. The key element has in its free end at least two lock activating contact points lying in different planes for disengaging the actuator retention member to thereby release the actuator and cause the locking mechanism to engage the key element in the housing.

13 Claims, 14 Drawing Figures

LOCKING DEVICE FOR INTERLOCKING NESTED SHOPPING CARTS

BACKGROUND OF INVENTION

1. Field of the Invention

The present invention relates to an improved locking device for interlocking at least two nested shopping carts to one another, and particularly relates to a locking device which is secured at a predetermined location on the shopping cart, such as for example to the handlebar thereof.

2. Description of Prior Art

There has long existed a problem that when shopping carts are used out of doors to transport goods to one's vehicle from a commodity store, airport, etc., these shopping carts are often left in parking lots where such are subjected to damage and theft. Also, in large shopping complexes, a parking lot may service many convenience stores each having their own shopping carts, and often these carts are identical or similar to those of other stores and consequently a problem occurs as to the ownership of these carts. To resolve this problem various devices have been provided wherey shopping carts may be taken out of doors only by inserting coins in a machine and wherein the coins are returned to the owner when the cart is returned. For example, it is known to provide a gate at the exit of a convenience store whereby the shopping cart may be taken out of the store by opening the gate by inserting coins in a gate unlocking device. However, such devices have been found unsatisfactory for various reasons, as the gates cause congestion, obstuct the path for other vehicles, and obstruct pedestrian traffic.

In recent years there has been developed another type of locking device whereby to interlock nested shopping carts. Each nested cart has a lock which interlocks with another lock of an adjacent nested shopping cart. Therefore, such carts may be left outside and interlocked in nested relationship, and by inserting a coin in the device secured to the end one of the carts, the cart is unlocked. When the cart is returned, by inserting a key element into the lock, the coin is released from the lock device. Such lock devices have been found quite acceptable on the marketplace. However, these have also developed various other problems such as locks jamming, breaking and becoming inoperative due to severe climatic conditions that they are exposed to. Further, the complex mechanisms often break down rendering the lock inoperative and many nested shopping carts inactive, all of which make irate customers.

SUMMARY OF INVENTION

It is a feature of the present invention to provide an improved locking device of the type which is secured to a shopping cart to interlock nested shopping carts and which substantially overcomes all of the problems of the prior art.

Another feature of the present invention is to provide a locking device which is secured to a shopping cart to interlock nested shopping carts and wherein the mechanism is simple in construction and which is not affected by climatic conditions, such as rain, sleet, snow, dust, cold and warm weather.

According to the above features, from a broad aspect, the present invention provides a locking device for intelocking at least two nested shopping carts. The device comprises a housing securable at a predetermined location on the shopping cart. A coin-activating unlocking actuator is movably mounted in the housing for displacement on a working axis. The actuator has coin-carrying means. An arresting means limits inward displacement of the actuator along the working axis in the absence of one or more coins in the carrying means. A locking mechanism is displaceably mounted inside the housing and has a lock pin engageable with a removable key element and a lock pin displacing member. Engaging means is provided for engaging the actuator in the housing. The key element has means for disengaging the engaging means to release the actuator and cause the lock pin to engage the key element.

BRIEF DESCRIPTION OF DRAWINGS

A preferred embodiment of the present invention will now be described with reference to the accompanying drawings, in which.

DESCRIPTION OF PREFERRED EMBODIMENTS

Figure 1:
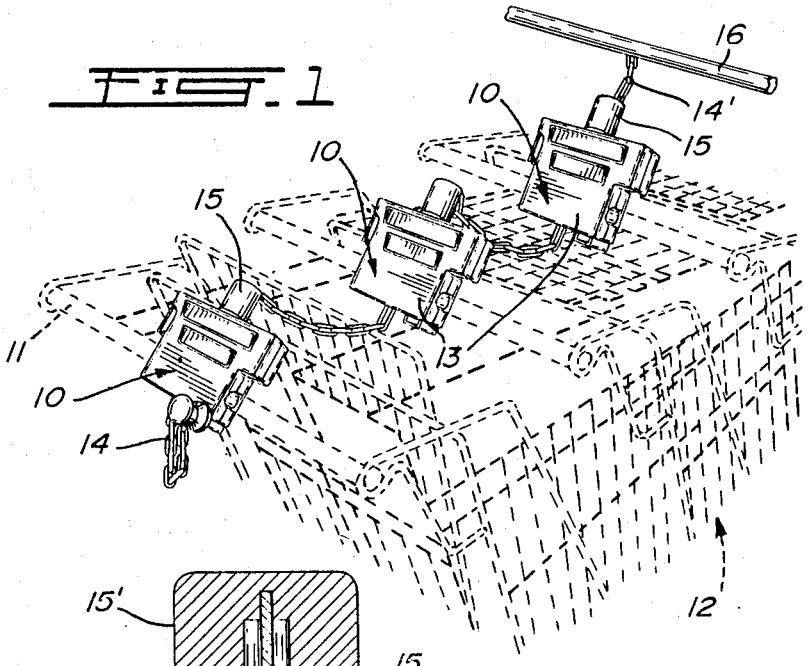
FIG. 1 is a perspective view illustrating the locking device of the present invention as secured to a plurality of nested shopping carts.

Referring now to the drawings and more particularly to FIGS. 1 to 5, there is shown generally at 10 the locking device of the present invention. As shown, the locking device is secured to the handlebar 11 of a shopping cart 12 whereby to interlock at least two, herein a plurality of nested shopping carts. The device comprises a housing 13 having a chain or strong cable 14 secured to a bottom wall 9 of the housing 13, and having a key element 15 secured to the free end thereof with its key shaft 15″ engageable in a key receiving slot 13′ provided in the opposite top wall 9″ of the housing 13. The key shaft 15″ is interlocked inside the housing.

Thus, adjacent nested shopping carts 12 are locked together via the chain or cable 14 which spans two locking devices 10. The chain is also of a selected length whereby to prevent the key shaft 15'' associated therewith from entering the key slot 13' of the same housing. The foremost one of the nested shopping carts 12 is secured to an anchor bar 16 having a chain 14' and a key element 15 permanently secured thereto. Accordingly, the entire nested assembly of the shopping carts 12 are attached to the locking bar 16 via their interlocked lock housings 13.

Basically, the locking device 10 of the present invention comprises a coin-activated unlocking actuator 17, an arresting member 24, a locking mechanism 18, an actuator member 19, and a key 15 having a key end 20 (see also FIG. 7) coacting with the actuator retention member 19.

The coin-activated unlocking actuator 17 is herein shown as a slide block received captive in the housing 13 and slidingly mounted in the housing for displacement on a longitudinal working axis. A finger gripping free end 22 is accessible from adjacent the side wall of the housing 13 and permits the actuator 17 from being drawn out of the housing, against a spring restoring force, whereby to expose one or more coin slots 23 (herein two being shown in FIG. 5) for insertion of a coin(s) 24' therein to permit the actuator to displace the arresting means 24 and to unlock the key element 15 which is retained captive in the housing by the locking mechanism 18.

Figure 5:
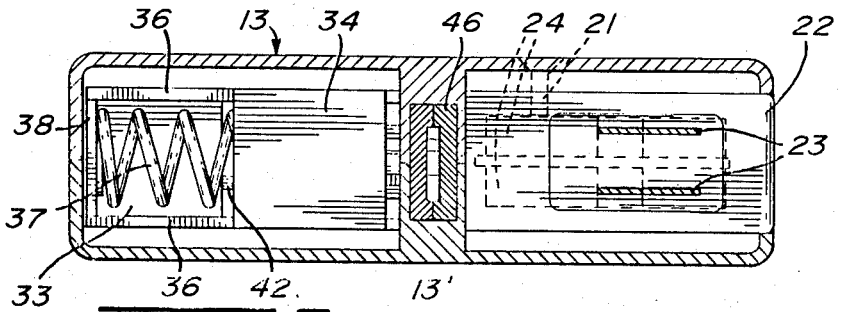
FIG. 5 is a transverse section view of a top portion of the locking device (this Figure appears on the drawing sheet with FIG. 2)
Figure 6:
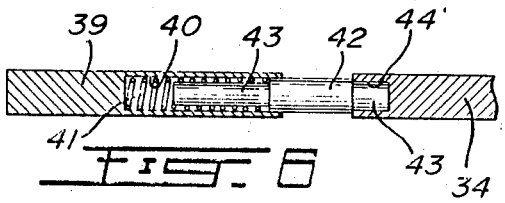
FIG. 6 is a section view of the ejector mechanism (this Figure appears on the drawing sheet with FIG. 1)

If the actuator 17 does not have a coin(s) in the coin slot(s) 23, its sliding movement within the housing 13 is limited and arrested by a spring biased retention hook or arm 24 which has a gripping end 25 which is urged by a spring 24' for engagement in a notch 26 provided in the actuator 17. As shown in FIG. 5, there may be provided two such spring biased retention arms 24, each aligned with a respective one of the coin slots 23 whereby two coins would be required to permit the actuator 17 to disengage the lock and remove the key 15. If only one coin slot is to be used, one of the retention arms 24 is retained deactivated by a set screw 21 extending through the housing and which maintains one of the arms 24 upwardly disposed, above the notch 26.

Figure 2A:
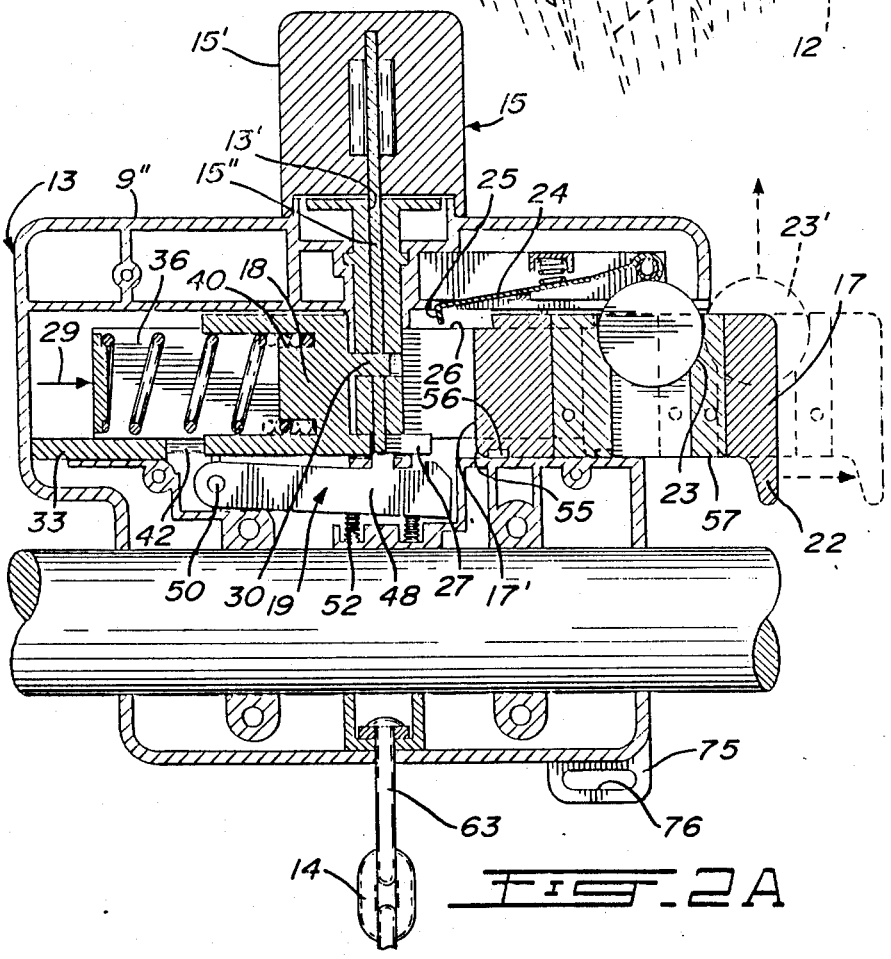
FIG. 2A is a simplified section view showing the locking mechanism of the locking device of the present invention with the key element in a locked position.
Figure 2B:
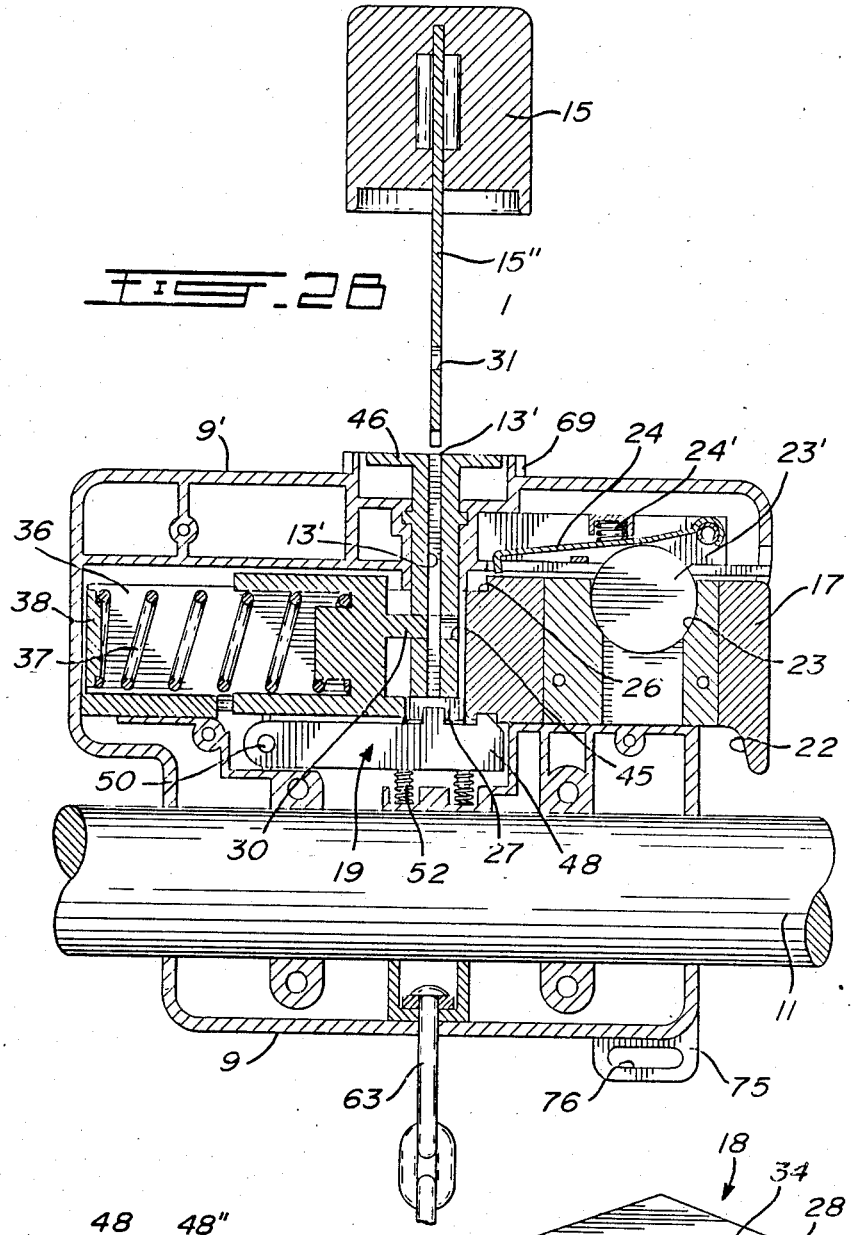
FIG. 2B is a view similar to FIG. 2A but illustrating the locking device in its unlocked position with the key element free.
Figure 2C:
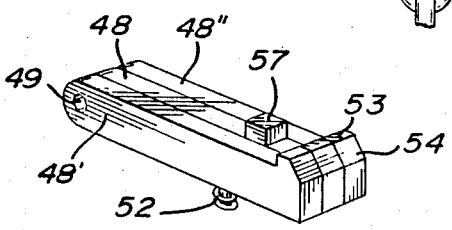
FIG. 2C is a perspective view of the retention members.
Figure 3:
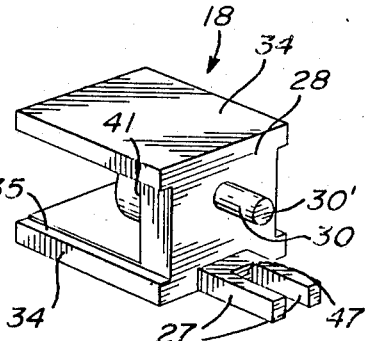
FIG. 3 is a perspective view of the locking mechanism.

As shown in FIGS. 2 and 3, when one or more coins 24 are inserted in the slots and the actuator 17 is moved inwardly into the housing, the spring biased retention arms 24 are pushed upwardly by the coins 23 to disengage the arms 24 from the notch 26 thus permitting the actuator 17 to travel further along its working axis inside the housing where its end wall 17' abuts against a lock pin displacing member 27 formed integral with the lock mechanism block 18 which is also displaceably mounted inside the housing and lies on the working axis 21.

Referring more specifically to FIG. 3, there is shown the construction of the lock mechanism block 18. As herein shown, the block has opposed top and bottom slide plates 34 each having a pair of longitudinal slots 35 therein which slots are engaged in the elongated side walls 36 of the unlocking actuator, which walls are spaced apart to accommodate therebetween a coil spring 37 which biases the unlocking actuator 17 inwardly in the housing 13 in a direction opposite to arrow 29. This spring is retained captive between an end wall 38 and an annular slot 40 disposed in a rear wall 41 of the lock mechanism block 18. A further spring biasing means is constituted by a flat rectangular piston housing 39 having a pair of opposed piston cavities 40 for receiving therein a coil spring 41 and a connecting end of a piston pin 42. The connecting end 43 is of smaller diameter than the piston pin 42 to receive the spring 41 thereabout. The piston 42 is further provided with a connecting head 43, also of smaller diameter, and which is received within a respective one of head receiving cavities 44 provided in the end wall of the lower plate 34 of the lock mechanism block 18. Thus, these pins 42 bias the lock mechanism block 18 forwardly in the direction of the arrow 29.

As shown in FIG. 3, a lock pin 30 extends forwardly of the front wall 28 of the lock mechanism lock 18 and is aligned to traverse a slot 45 which is provided in a key slot forming member 46. This slot 45 is disposed for alignment with a lock pin receiving aperture 31 provided in the key shaft 15''. The lock pin displacing member 27 is also provided with a slot 47 therein to permit passage of a key ejector pin as will be described later.

Figure 7:
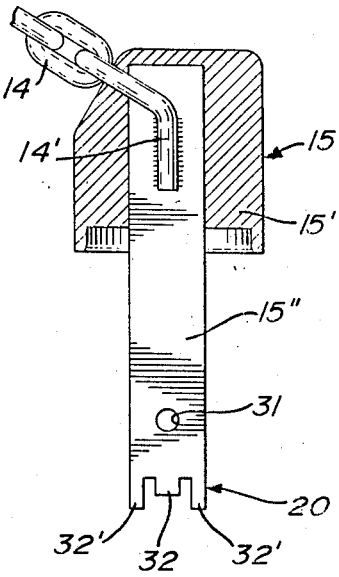
FIG. 7 is a cross section view showing the construction of the key element.

As shown in FIG. 7, the key element 15 comprises a handle grip portion 15' and a metal key shaft 15''. The key shaft is preferably made of tempered steel and has a lock pin receiving aperture 31 of sufficient size to freely receive the lock pin 30 therethrough. The free end of the key shaft 15'' is provided with at least two lock activating contact points, three of such points being shown in FIG. 7 and designated by reference numerals 32, 32' and 32'', the purpose of which will be described later. A loop end 14' of the chain 14 is welded to each side of the key shaft 15'' for rigid engagement therewith.

The actuator retention member 19 may be provided as a single spring-bias retention arm 36, as shown in FIG. 2A, or else may comprise two or three spring-biased retention arms 48,48' and 48'', as shown in FIG. 2C. These arms 48, 48' and 48'' have a pivoted end 49 which is hingedly secured on a pivot pin 39 (see FIG. 2A). The arms are springbiased upwardly toward the lower surface 51 of the actuator 17 by means of individual springs 52. Each of the arms, either 48, 48' or 48'', has a hook end 53 and defining a sloped forward face 54 which is of wedge shape.

As shown in FIGS. 2A and 2B, when the forward face 17' of the actuator is advanced its lower edge surface 55 will push the displacing member 27 thus pushing the locking mechanism block 18 to a position where the lock pin 30 no longer engages the key shaft 15'' (FIG. 2B). At this position the hook end 53 of the arms 48, 48' and 48'' enter a retenion slot 56 in the lower surface 51 of the actuator block 17 to immovably engage the actuator 17 inside the housing 13. Thus, the actuator 17 cannot be pulled outside the housing by the finger gripping free end 22, as it is retained therein by the hook end 53 of the retention arms. A metal inset 30' is disposed in the lock pin 30 to add rigidity to the pin and reduce wear due to metal friction with the shaft 15''.

As seen in FIG. 2C, the center one of the spring-biased retention arms, namely arm 48, has an ejector pin 57 formed integral therewith and extending vertically thereabove and aligned with the free end of the key shaft 15'' and the slot 47 of the displacing member 27. Thus, as the lock pin 30 is retracted from the aperture 31 in the key shaft 15'' the spring-biased retention arm 48 and the arms 48' and 48'' move into the cavity 56, and this abrupt spring biased upward movement of the arm 48 causes the ejector pin 57 to push the key shaft and key 15 upwardly in the key slot 13' to lift it in its slot indicating disengagement.

In order to prevent tampering and opening the lock without the use of a key, the key end is provided with at least two or more lock activating contact points which lie in different planes. As shown in FIG. 7, the contact points 32′ and 32″ will engage with the upper surface of the arms 48′ and 48″ while the contact point 32 will engage with the top of the ejector pin 57 causing the arm 48, 48′ and 48″ to move downwardly simultaneously. Thus, to disengage the spring-biased retention arms it is necessay to press on all three distinct points at the same time. This prevents opening of the lock by inserting a pin or nail therein. It is also possible, although not shown, to provide the arm 48′ and 48″ with distinct elevated areas to be contacted by the contact point 32′ and 32″ which would lie in different planes from one another and coincide with the contact point 32′ and 32. With such an arrangement, however, the key shaft 15″ could only be disposed in one direction in the slot 13′.

The operation of the lock mechanism will now be briefly summarized. By inserting the key shaft 15″ of the key element 15 in a key slot 13′ of the housing 13, the contact points at the free end of the key shaft engage with respective portions of the spring-biased retention arms 48, 48′ and 48″, causing the arms to move downwardly against individual springs thereby releasing their engagement with the actuator 17. The spring force of the piston pins 42 therefore pushes the locking mechanism block 18 forward in the direction of arrow 29 causing the lock pin 30 to enter the aperture 31 in the key shaft 15″ locking the key within the housing. At the same time the actuator 17 restores itself under the action of its spring bias moving slightly outward of the side of the housing. By pulling the actuator outwardly by the finger gripping free end 22 the coins 23′ may be removed from the slots 23. Thus, the lock housing of the associated shopping cart has been locked in nesting relationship with an adjacent nested shopping cart by the key of this adjacent cart.

In order to liberate an end one of the nested shopping carts, it is necessary to pull the actuator 17 outwardly of the housing and insert a coin(s) 23′ in the coin slot(s) 23 therein. The actuator is then released and fully pushed inside the housing where the front face 17′ of the actuator abuts against the lock pin displacing member 27 causing the lock pin 30 to retract the aperture 31 and the key shaft 15″ while simultaneously the hook ends 53 of the spring-biased retention arms 48, 48′ and 48″ move into the aperture 56 causing the pin ejector 57 to strike the key end moving the key 15 upwardly in the slot, thus permitting the key to be removed and the shopping cart to be liberated.

Figure 4:
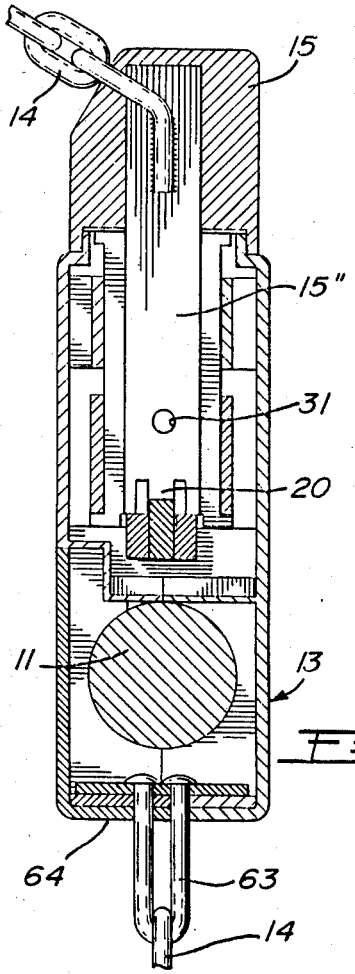
FIG. 4 is an end section view illustrating the construction of the locking device of the present invention shown in association with the key element in its locked position (this Figure appears on the drawing sheet with FIG. 1)
Figure 8:
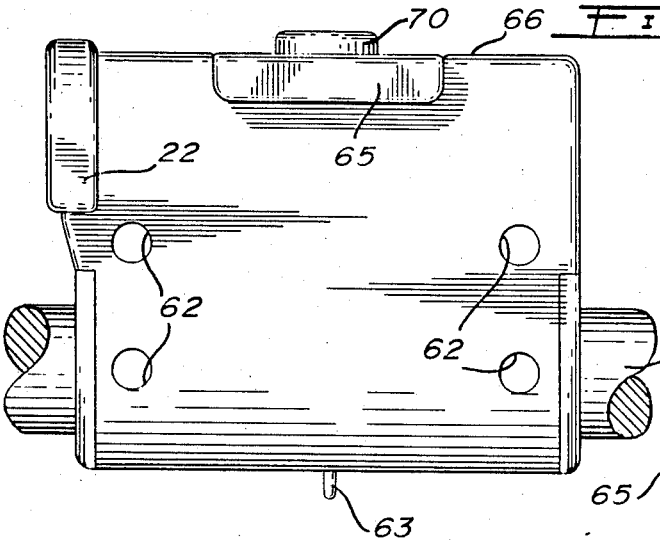
FIG. 8 is a front view of a preferred example of the exterior design of the locking device of the present invention.
Figure 9:
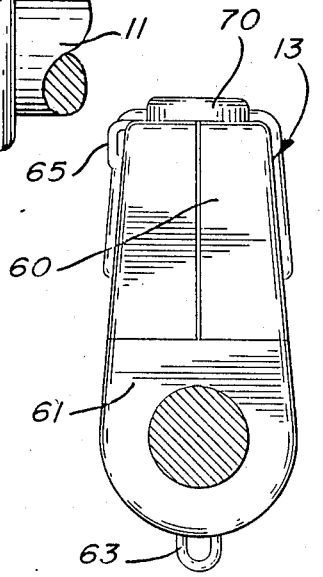
FIG. 9 is a side view of FIG. 1.

Referring now to FIGS. 8 and 9, there is shown a preferred form of construction of the lock housing 13 of the present invention. As herein shown, the housing 13 comprises an upper section 60 which houses the lock mechanism and a lower section 61 for securing the housing 13 to the handlebar 11 of a shopping cart. A pair of holes 62 are provided in the lower section 61 whereby a fastener (not shown) may extend through the lower section 61 and the handlebar. A loop member 63 depends from the bottom edge of the housing for attaching a chain 14 or a cable thereto. As shown in FIG. 4, the loop member 63 may be of an elongated U-shaped form whereby to permit adjustment of the chain 14 in the direction of the top wall of a housing in an adjacent nested cart but prevent the key element 15 from being inserted in the keyhole on the top of its housing. Thus, the length of the chain becomes adjustable in the direction away from the bottom wall 64 of the housing 13 but not in the direction towards the top wall of the housing.

Figure 10:
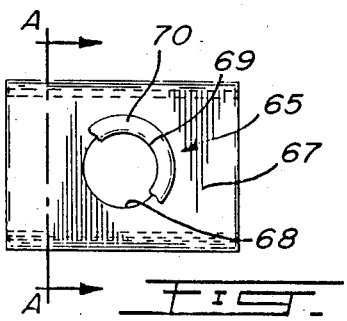
FIG. 10 is a plan view of the retention clip.
Figure 11:
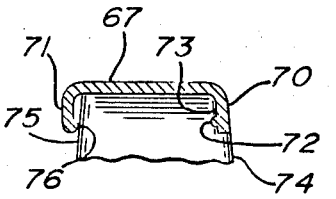
FIG. 11 is a cross section view of FIG. 10 along cross-sectional lines A—A.

Referring now additionally to FIGS. 10 and 11, there is shown the construction of a retention clip 65 which is formed as a flat inverted U-shaped clip which is retained over the top wall 66 of the housing 13. The clip has a flat base portion 67 with a circular hole 68 formed therein for passage of a collar member, such as 69 shown in FIG. 2B, therethrough, whereby a cap 70′ may be secured about the collar 69 to retain the clip 65 immovably on the top wall 66. Opposed side arm portions 70 and 71 are formed integral with the base portion 67 and depend therefrom at an angel of substantially 90°. Side arm portion 70 is provided with a retention bead 72 formed horizontally therein and being received in a corresponding slot 73 formed in the back wall 74 of the housing whereby to retain the clip firmly in position. The other side arm 71 depends over a top edge of the front wall 75 of the housing and is also provided with a beaded end 76 which is spring biased against the front wall 75 whereby to constitute a retention edge. The clip is also formed of a suitable plastics material to provide a spring restoring force. Accordingly, a flat article such as paper or a flat calculator may be retained over the flat front face 75 of the housing for reference thereto while a person is shopping in a convenience store.

Figure 12:
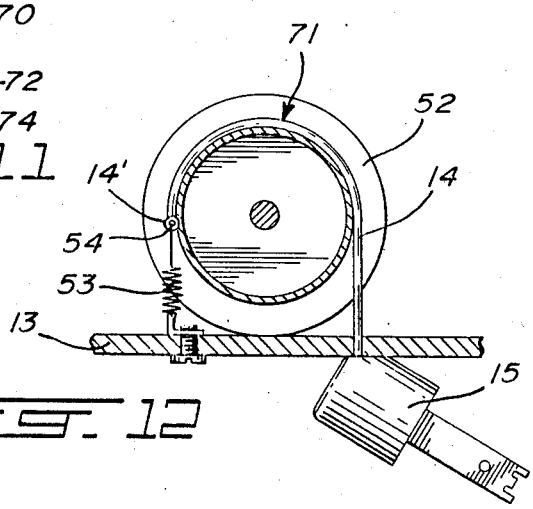
FIG. 12 is a fragmented view illustrating a retractor mechanism for the cable of a key element.

Referring now to FIG. 12, there is shown a retractor mechanism 71 which may be incorporated with the housing 13 and comprising a guide wheel 72 about which the chain or cable 14 is retracted by the spring 73 connected to the free end 14′ of the cable. A stop pin 74 is also secured to this end to provide rigid connection with the housing 13. Thus, when the key element 15 is removed from the key slot 13′, it is automatically retracted within the housing at a convenient location, usually adjacent the lower end thereof. As herein shown, the wheel 72 merely acts as a guide and support for the predetermined length of cable 14. Alternatively, this retractor mechanism 71 may be provided as a separate spool housing which is secured to the housing wall.

FIG. 2A illustrates a still further embodiment of a key holding means. As herein shown, the housing may be provided with a slotted member 75 having a slot 76 to receive the key shaft 15″ of the key element 15, when not in use. The reason for these holding means or cable retracting means is not to have the key element and the chain loose in front of the shopping cart whereby when the outermost one of the nested carts is removed, that key element and chain could engage with the cart causing damage to the key element, key chain, or the housing, or causing injury to the user. The hanging chain and key may also be hazardous to small children.

The locking device 10 of the present invention has many advantages over similar locking devices of the prior art. A main advantage is that the coinactivated unlocking actuator is permanently biased inside the housing thus concealing the coin slots. The advantage of concealing the coin slots is to protect them against foreign matter entering therein and clogging the slots, preventing the proper insertion of coins, thus preventing the shopping carts from being removed from a plurality of shopping carts. Thus, many shopping carts could be rendered inactive if the outermost one cannot be disconnected. Also, when these shopping carts are nested outside in severe weather conditions such as freezing rain or snow, such rain or snow usually lodges itself within the slots and freezes therein—again preventing proper operation of the locking device.

Another advantage of the present invention is the provision of a strong attachment between the key shaft and the chain, thus preventing this attachment from breaking when an entire assembly of nested carts is pulled together. It is noted here that the key connection of the end one of the plurality of nested carts will take the entire load of all the other carts when pulling these carts together.

Another advantage of the lock of the present invention over the prior art is the adjustable chain feature provided by the elongated loop and connection of the chain with the bottom of the housing preventing the key from being inserted in the key slot of its housing by preventing adjustment of the length of the key chain. This is particularly useful when shopping carts are slightly damaged and do not mesh perfectly. Otherwise, the key of the adjacent shopping car would not reach the key slot of the shopping cart wanting to be nested therewith.

A still further advance of the lock housing of the present invention is the provision of the key holding means which permits the key to be retained in a slot or otherwise on the housing 13 whereby to prevent the key from dangling and cause injury or other damage.

Another feature of the present invention is the provision of a lock housing molded of plastic and wherein locks may be molded of different colors whereby to segregate shopping carts of a particular convenience store as compared to shopping carts of another convenience store which may be located in the same shopping complex. Accordingly, the ownership of shopping carts can be readily identified.

Another feature of the present invention is the provision of an actuating member having more than one coin slot therein and having arresting elements mounted within the housing which can be activated to accommodate one or two coin slots. It is also foreseen that three or four coins could be utilized using the same principle.

Another advantage of the present invention over the prior art is the provision of a retention clip associated with a flat portion of the housing whereby to retain flat objects such as an electronic calculator or a note sheet for access thereto by a person doing his shopping.

I claim:

1. A locking device for interlocking at least two nested shopping carts, said device comprising a housing having attachment means to immovably secure same at a predetermined location on a shopping cart handle, a coinactivated unlocking actuator movably mounted in said housing for displacement on a working axis, said actuator having coin-carrying means having at least one coin slot in a wall of said actuator, actuator spring biasing means to bias said actuator inwardly of said housing to position said coincarrying means and coin slot inside said housing, arresting means limiting inward displacement of said actuator along said working axis in the absence of at least one coin in said carrying means, a locking mechanism displaceably mounted inside said housing and having a lock pin and a lock pin displacing member, a key element receivable in a key slot in said housing and immovably engageable by said lock pin, and an actuator retention member having at least one retention element, one of which has a pin ejector associated therewith for engaging said actuator in said housing, said key element having at least two lock disengaging contact points in a free end of said key for disengaging said engaging means to thereby release said actuator and cause said locking mechanism to engage said key element in said housing, said contact points lying in two different planes and disposed to contact a respective one of said at least one retention element.

2. A locking device as claimed in claim 1, wherein there is provided second spring biased means to bias said locking mechanism toward said actuator.

3. A locking device as claimed in claim 2, wherein said actuator spring biasing means is comprised by a coil spring biasing said actuator inwardly of said housing.

4. A locking device as claimed in claim 2, wherein said second spring biased means is a pair of spring biased piston pins having a connecting head received in a respective cavity of an end wall of said locking mechanism to urge said mechanism toward said actuator.

5. A locking device as claimed in claim 2, wherein said actuator coin-carrying means comprises at least two coin slots in a top wall of said actuator, said means limiting inward displacement of said actuator comprising at least two spring biased retention fingers engageable with said actuator to limit inward displacement thereof in said housing, each said fingers being disengaged by a coin located in said slots.

6. A locking device as claimed in claim 2, wherein said actuator coin-carrying means comprises at least two coin slots in a top wall of said actuator, said actuator being biased inwardly of said housing with said coin slots located inside said housing, said actuator having a finger gripping free end to pull said actuator outwardly of said housing against the spring restoring force of said first spring biased means whereby to expose said coin slots to insert at least one coin therein.

7. A locking device as claimed in claim 2, wherein said locking mechanism lock pin is displaceably spring biased across the plane of said key slot and extends through a locking hole in said key element when said actuator is released by said lock disengaging contact points.

8. A locking device as claimed in claim 7, wherein said actuator retention member is comprised by two spring biased retention arms being pivotally connected at one end to a common stationary pivot axis, each arm having a hook end formed in its free end for engagement in a retention slot formed in said actuator, said arms having contact areas lying in different planes for simultaneous engagement by respective ones of said contact points of said key element.

9. A locking device as claimed in claim 7, wherein said actuator retention member is comprised by three spring biased retention arms, each arm having contact areas with at least two contact areas lying in different planes, said key element having three lock disengaging contact points with at least two contact points lying in a common plane, said pin ejector element being a pin formation extending in alignment with said free end of said key element.

10. A locking device as claimed in claim 1, wherein said key is secured to a cable of predetermined length which is secured to said housing remote from said key slot to prevent said key element from being inserted in the key slot of its housing, and key holding means associated with said housing to retain said key and cable in a non-obstructing position.

11. A locking device as claimed in claim 10, wherein said key holding means is a retractor mechanism having a cable retracting spool for automatically retracting said cable in a cable housing when said key is unlocked from the key slot of the housing of the locking device of an adjacent nested shopping cart.

12. A locking device as claimed in claim 10, wherein said key holding means is a slot member on said housing, said slot being dimensioned to supportingly receive said key element therein.

13. A locking device as claimed in claim 1, wherein said key element is secured to a bottom wall of said housing, a cable member secured to an elongated loop member depending from said bottom wall, said loop member permitting said cable to be extended in a direction away from said housing and preventing said key element from being inserted in a remote keyhole in said housing.

* * * * *